US009999556B2

(12) United States Patent
Magill et al.

(10) Patent No.: US 9,999,556 B2
(45) **Date of Patent: *Jun. 19, 2018**

(54) ROLL-IN PUSH COT

(71) Applicant: Ferno-Washington, Inc., Wilmington, OH (US)

(72) Inventors: Brian M. Magill, Cincinnati, OH (US); Kemal Burc Oz, Columbus, OH (US); Andrew Karth, Columbus, OH (US)

(73) Assignee: Ferno-Washington, Inc., Wilmington, OH (US)

( * ) Notice: Subject to any disclaimer, the term of this patent is extended or adjusted under 35 U.S.C. 154(b) by 207 days.

This patent is subject to a terminal disclaimer.

(21) Appl. No.: 14/799,937

(22) Filed: Jul. 15, 2015

(65) Prior Publication Data

US 2015/0313777 A1 Nov. 5, 2015

Related U.S. Application Data

(63) Continuation of application No. 13/509,117, filed as application No. PCT/US2010/056549 on Nov. 12, 2010, now Pat. No. 9,114,047.

(Continued)

(51) Int. Cl.

| | |
|---|---|
| ***A47B 7/00*** | (2006.01) |
| ***A61G 1/056*** | (2006.01) |
| ***A61G 1/02*** | (2006.01) |

(52) U.S. Cl.

CPC ..... *A61G 1/056* (2013.01); *A61G 1/02* (2013.01)

(58) Field of Classification Search

CPC .. A61G 1/0212; A61G 1/0262; A61G 1/0237; A61G 1/0562; A61G 1/013

(Continued)

(56) References Cited

U.S. PATENT DOCUMENTS

| | | | |
|---|---|---|---|
| 4,037,871 | A | 7/1977 | Bourgraf et al. |
| 4,921,295 | A | 5/1990 | Stollenwerk |

(Continued)

OTHER PUBLICATIONS

Egyptian Examination Report dated Feb. 26, 2016 for Egyptian Patent Application PCT/NA/853/2012 entitled "Roll-In Push Cot" in the name of Femo-Washington, Inc.

(Continued)

*Primary Examiner* — David E Sosnowski

(74) *Attorney, Agent, or Firm* — Dinsmore & Shohl LLP

(57) ABSTRACT

Embodiments of a method of operation of a roll-in push cot for transport onto a first surface comprising initially loading the roll-in cot onto a first surface thereby releasing automatically at least one leading leg, continuing of loading the roll-in cot onto the first surface to move a front carriage member toward a front actuator, such that movement of the front carriage member triggers the front actuator that releases a middle release lever, thereby initiating the release of at least one trailing leg, supporting the weight of the cot at least partially in order to disengage a locking mechanism for the at least one trailing leg, and loading the cot in order to move a rear carriage member in conjunction with folding of the at least one trailing leg and thereby trigger a reset actuator and release a latch pin to engage the rear carriage member when the trailing and leading legs of the roll-in push cot are in a fully folded position on the first surface.

19 Claims, 18 Drawing Sheets

Related U.S. Application Data

(60) Provisional application No. 61/261,074, filed on Nov. 13, 2009.

(58) Field of Classification Search
USPC ..... 5/86.1, 618, 83.1, 610, 611; 296/20
See application file for complete search history.

(56) References Cited

U.S. PATENT DOCUMENTS

| | | | | |
|---|---|---|---|---|
| 6,735,794 | B1 * | 5/2004 | Way | A61G 1/0293 16/35 R |
| 7,478,855 | B2 | 1/2009 | Lambarth et al. | |
| 7,631,373 | B2 | 12/2009 | Broadley et al. | |
| 9,114,047 | B2 * | 8/2015 | Magill | A61G 1/02 |
| 2006/0082176 | A1 * | 4/2006 | Broadley | A61G 1/0293 296/20 |
| 2006/0225203 | A1 | 10/2006 | Hosoya et al. | |
| 2008/0189860 | A1 | 8/2008 | Pollock | |
| 2008/0258486 | A1 | 10/2008 | Broadley et al. | |
| 2011/0266821 | A1 | 11/2011 | Goto et al. | |

OTHER PUBLICATIONS

Office Action dated Nov. 22, 2016 pertaining to Canadian Patent Application No. 2,780,635.

* cited by examiner

ROLL-IN PUSH COT

This application is filed as a continuation of U.S. application Ser. No. 13/509,117 filed on Jul. 11, 2012, which is a national stage entry of PCT/US2010/056549 filed Nov. 12, 2010, which claims priority to U.S. Provisional Application Ser. No. 61/261,074 filed on Nov. 13, 2009.

Embodiments of the present application are generally related to emergency cots, and, specifically, to roll-in emergency cots that provide better management of the cot weight.

Emergency roll-in cots are used to hold an individual on a stretcher, the stretcher being placed on a wheeled support frame. The individual may be moved on the cot by a single operator at the trailing end or leading end, or by operators on the wheeled support frame. Conventional emergency cots include a stretcher that is removably attached to a wheeled transporter where the stretcher may be separately removed from the support frame to horizontally move the patient. The legs may have to be released by the operator while bearing the weight of the cot and the stretcher. Thus, it is desirable for the operator with assistance from the cot's mechanisms to release the legs.

In one embodiment, a roll-in push cot, is provided wherein the cot may comprise a support frame that may include a pair of lateral sides extending between a front end and a rear end, and a pair of slidable tracks disposed in the lateral sides; a pair of leading legs and a pair of trailing legs pivotally connected to the support frame; a front carriage member slidingly disposed within the pair of slidable tracks at the front end of the support frame, wherein the sliding motion of the front carriage member defines a motion path; a pair of front hinge members pivotally connected to the pair of leading legs at one end of the pair of front hinge members and slidingly connected to the front carriage member at an opposite end of the pair of front hinge members, wherein loading of the cot onto a first surface folds the pair of front hinge members and triggers the sliding of the front carriage member along the motion path; and a mechanical loading system coupled to the support frame and connecting the pair of leading legs with the pair of trailing legs, wherein the mechanical loading system comprises a front actuator disposed on the support frame in the motion path defined by the front carriage member, such that movement of the front carriage member triggers the front actuator and thereby initiates the release of the trailing legs.

In yet another embodiment, a roll-in push cot, is provided wherein the cot may comprise a support frame comprising a pair of lateral sides extending between a front end and a rear end, and a pair of slidable tracks disposed in the lateral sides; a pair of leading legs and a pair of trailing legs pivotally connected to the support frame; a front carriage member slidingly disposed within the pair of slidable tracks at the front end of the support frame, wherein the sliding motion of the front carriage member defines a motion path; a pair of front hinge members pivotally connected to the pair of leading legs at one end of the pair of front hinge members and slidingly connected to the front carriage member at an opposite end of the pair of front hinge members, wherein loading of the cot onto a first surface collapses the pair of front hinge members and triggers the sliding of the front carriage member along the front carriage member motion path; a rear carriage member slidingly coupled to pair of slidable tracks at the rear end of the support frame, wherein the sliding motion of the rear carriage member defines a motion path; a pair of rear hinge members pivotally connected to the pair of trailing legs at one end of the pair of rear hinge members and slidingly connected to the rear carriage member at an opposite end of the pair of rear hinge members, wherein loading of the cot onto a first surface folds the pair of rear hinge members and triggers the sliding of the rear carriage member along the rear carriage member motion path; and a mechanical loading system coupled to the support frame and connecting the pair of leading legs with the pair of trailing legs, wherein the mechanical loading system comprises a front actuator disposed on the support frame in the motion path defined by the front carriage member, a middle release lever coupled to the front actuator, wherein movement of the front carriage member triggers the front actuator and pulls the middle release lever, a latch pin configured to lock the trailing legs by engaging the rear carriage member, wherein the latch pin is disengaged by an operator supporting a portion of the weight of the roll-in cot, and a reset actuator disposed on the support frame in the rear carriage member motion path such that movement of the rear carriage member triggers the reset actuator, the triggering of the reset actuator being configured to lock the roll in cot when the trailing and leading legs of the cot are in a folded position.

In another embodiment, a method of operation of a roll-in push cot for transport onto a first surface, the method may comprise initially loading of the roll-in cot onto a first surface thereby releasing automatically at least one leading leg; continuing loading the roll in cot onto a first surface to move a front carriage member toward a front actuator, such that movement of the front carriage member triggers the front actuator that releases a middle release lever, thereby initiating the release of the trailing legs; supporting the weight of the cot at least partially in order to disengage a locking mechanism for at least one trailing leg; and loading the cot in order to move a rear carriage member and thereby trigger a reset actuator, the reset actuator allowing for the complete loading of the roll-in cot onto the first surface.

The following detailed description of specific embodiments of the present disclosure can be best understood when read in conjunction with the following drawings, where like structure is indicated with like reference numerals and in which.

Figure 1A:
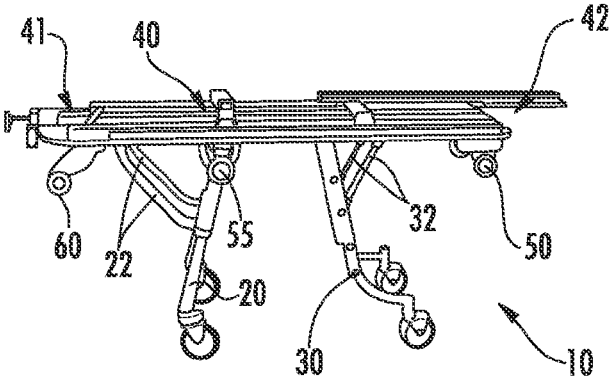
FIG. 1A is a side view of a roll-in cot prior to loading on a platform.

The embodiments set forth in the drawings are illustrative in nature and not intended to be limiting of the invention defined by the claims. Moreover, individual features of the drawings and invention will be more fully apparent and understood in view of the detailed description.

Figure 1B:
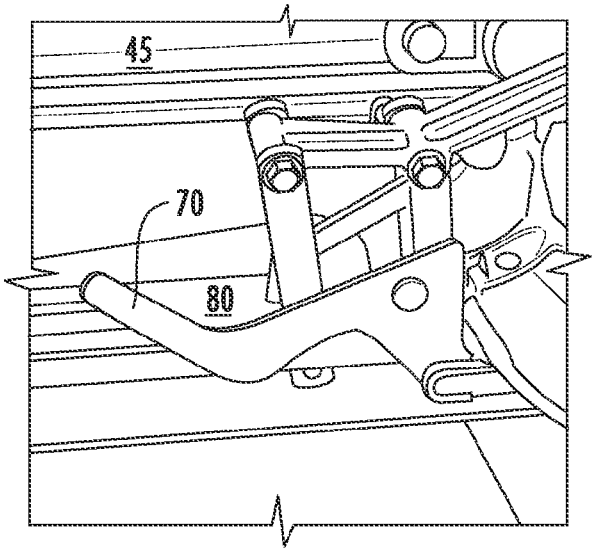
FIG. 1B is a side view of a front actuator on the underside of the cot at the loading position of FIG. 1A.
Figure 1D:
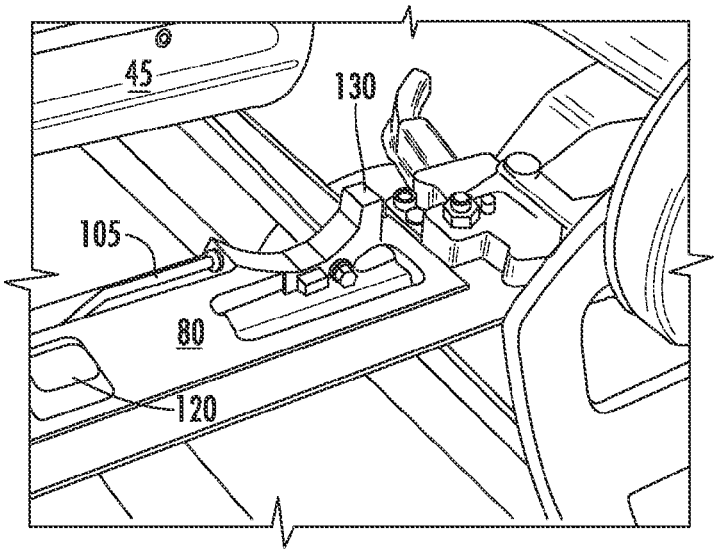
FIG. 1D is a perspective view of a reset actuator on the underside of the cot at the loading position of FIG. 1A.

Referring to FIGS. 1A and 1D, the roll-in push cot 10 comprises a support frame 40 comprising a pair of lateral sides extending between a front end 41 and a rear end 42, and a pair of slidable tracks 45 disposed in the lateral sides; a pair of leading legs 20 and a pair of trailing legs 30 pivotally connected to the support frame 40. The cot 10 may be coupled to other patient transport devices such as the stretcher of FIG. 10. Other patient transport devices such as spine boards, back boards, carts, and other mobility devices may be used with the cot. In one embodiment, the leading legs 20 may be coupled to the slidable tracks 45. The leading legs 20 are depicted as being slanted in FIG. 1A; however, various shapes and curvatures are contemplated. Additionally, as shown, the leading legs 20 include wheels at their lower end.

Figure 2A:
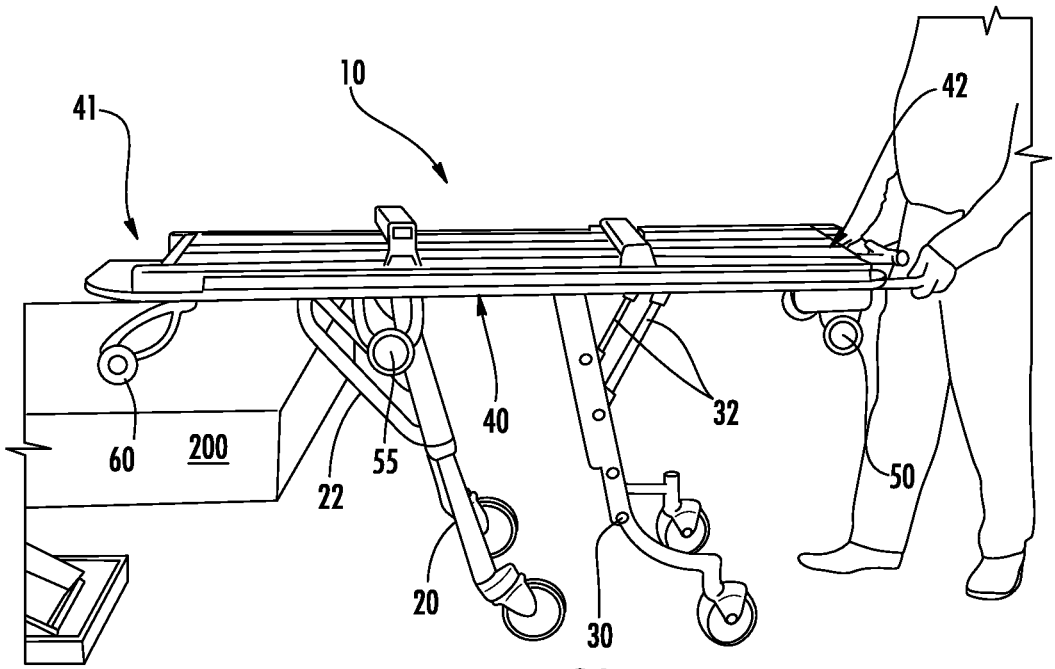
FIG. 2A is a side view of a roll-in cot after the leading legs have begun collapsing according to one or more embodiments of the present disclosure.
Figure 2B:
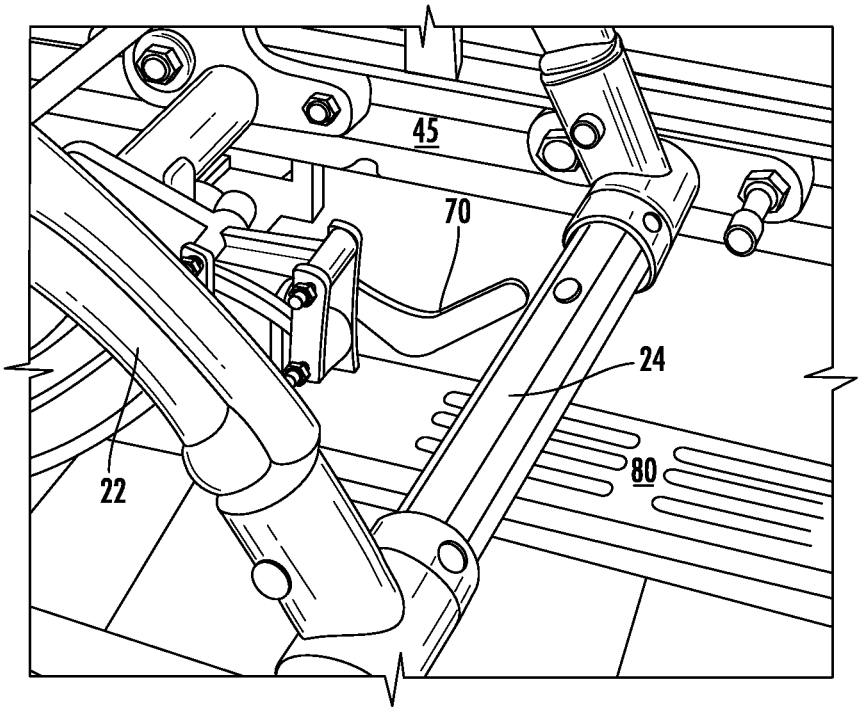
FIG. 2B is a perspective view of a front carriage member moving closer to the front actuator at the loading position of FIG. 2A.

Referring to FIG. 2B, the roll-in push cot 10 further comprises a front carriage member 24 slidingly disposed within the pair of slidable tracks 45 at the front end 41 of the support frame 40, wherein the sliding motion of the front carriage member 24 defines a motion path. The front carriage member 24 may also be disposed between respective slidable front hinge members 22. The front carriage member 24 may be a crossbar, frame, latch, horizontal assembly, or any other moveable component. While not shown, it is contemplated that the front hinge members 22 may be positioned at a different location on the support frame 40. Also, while the drawings depict the motion of the leading legs 20 as pivoting inwardly, it is contemplated that the leading legs 20 may also slide. Moreover, it is also contemplated that the leading legs 20 could pivot outwardly.

Referring to FIGS. 1A and 2A, the roll-in push cot 10 further comprises a pair of front hinge members 22 pivotally connected to the pair of leading legs 20 at one end of the pair of front hinge members 22 and slidingly connected to the front carriage member 24 at an opposite end of the pair of front hinge members 22, wherein loading of the cot 10 onto a first surface folds the pair of front hinge members 22 and triggers the sliding of the front carriage member 24 along the motion path (as shown in FIG. 2B). In other embodiments (not shown), the front hinge members may be disposed at a different location on the support frame. For example, the front hinge members 22 may be slidingly coupled to the pair of slidable tracks 45. The pair of slidable front hinge members 22 may be configured to slide on the pair of slidable tracks 45 and slide inwardly as the leading legs 20 collapse.

Referring to FIG. 1B, optionally, a central support beam 80 may extend between the front end 41 and the rear end 42 and disposed between the slidable tracks 45. The central support beam 80 may comprise an internal bar with one or more latching pins 120 as described below.

Figure 3A:
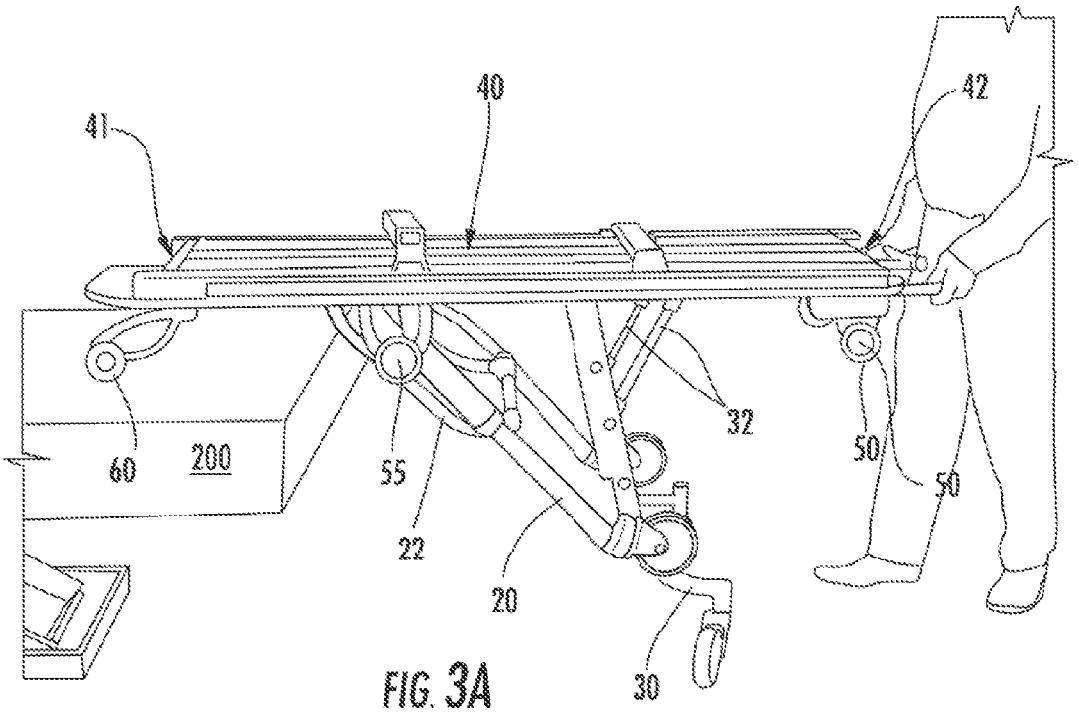
FIG. 3A is a side view of a roll-in cot collapsed to a point wherein the front carriage member partially engages the front actuator according to one or more embodiments of the present disclosure.
Figure 3B:
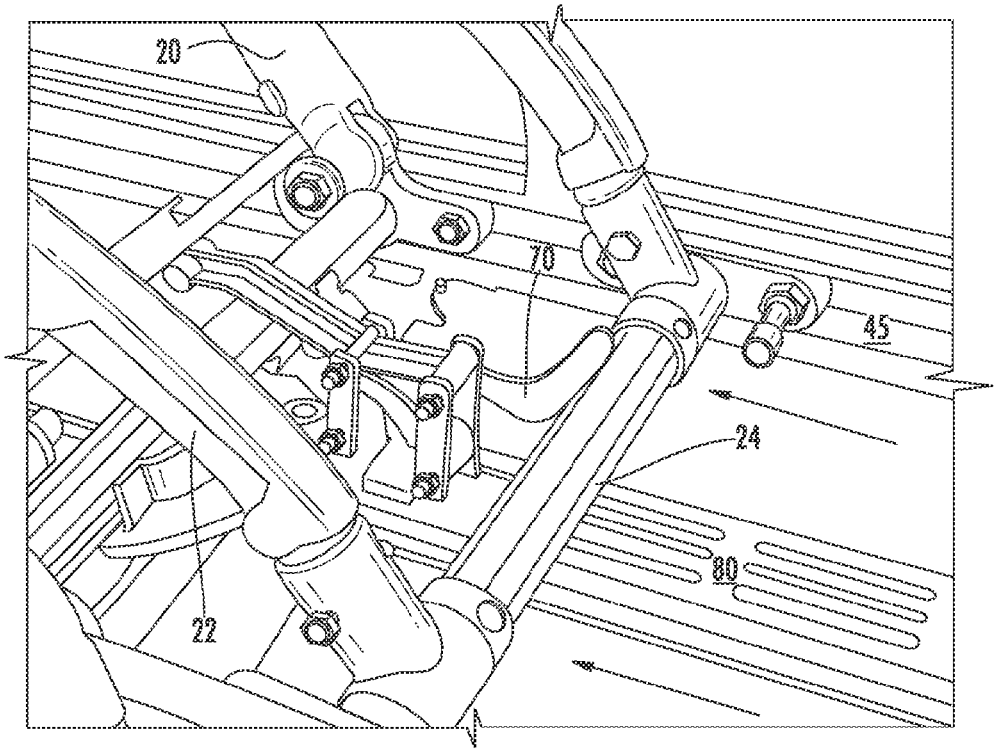
FIG. 3B is a perspective view of the front carriage member partially engaging the front actuator at the loading position of 3A.

Referring to FIGS. 1C, 3B, 3C, 11A, and 11B, the roll-in push cot 10 further comprises a mechanical loading system 100 coupled to the support frame 40. The loading system 100 connects the pair of leading legs 20 with the pair of trailing legs 30, wherein the mechanical loading system 100 comprises a front actuator 70 disposed on the support frame 40 in the motion path defined by the front carriage member 24, such that movement of the front carriage member 24 triggers the front actuator 70 (as shown in FIG. 3B) and thereby initiates the release of the trailing legs 30 as shown in FIG. 4A. Various components may be used for the front actuator 70, such as a switch, lever, button, and so forth.

Figure 1C:
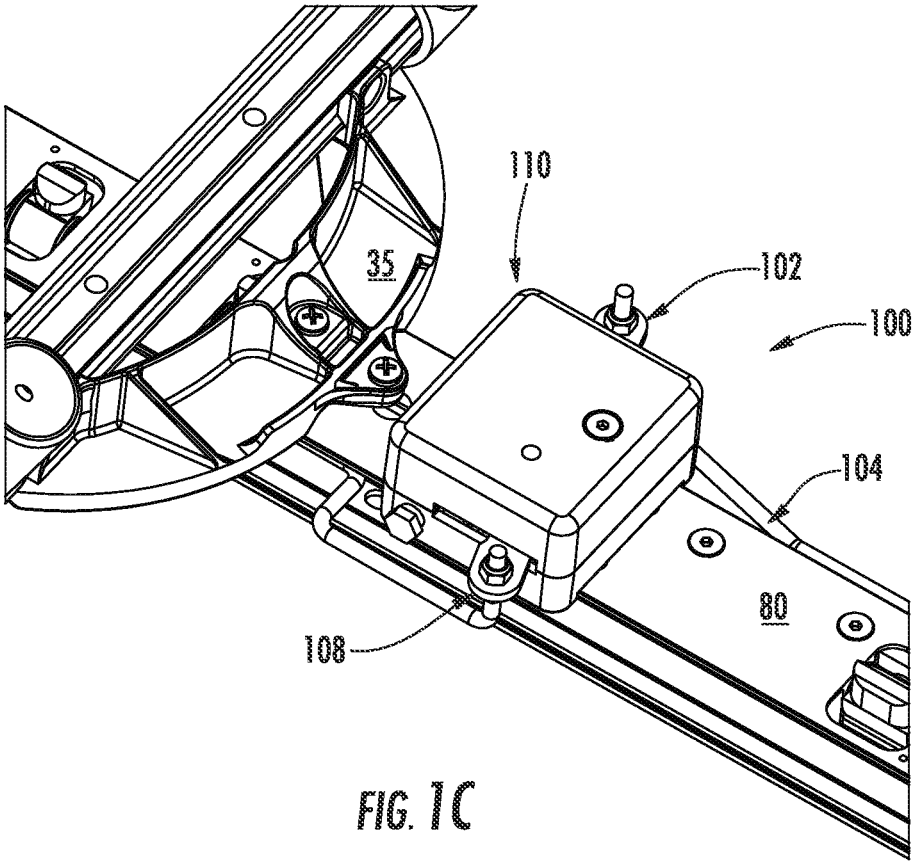
FIG. 1C is a perspective view of a middle control box on the underside of the cot at the loading position of FIG. 1A.
Figure 3C:
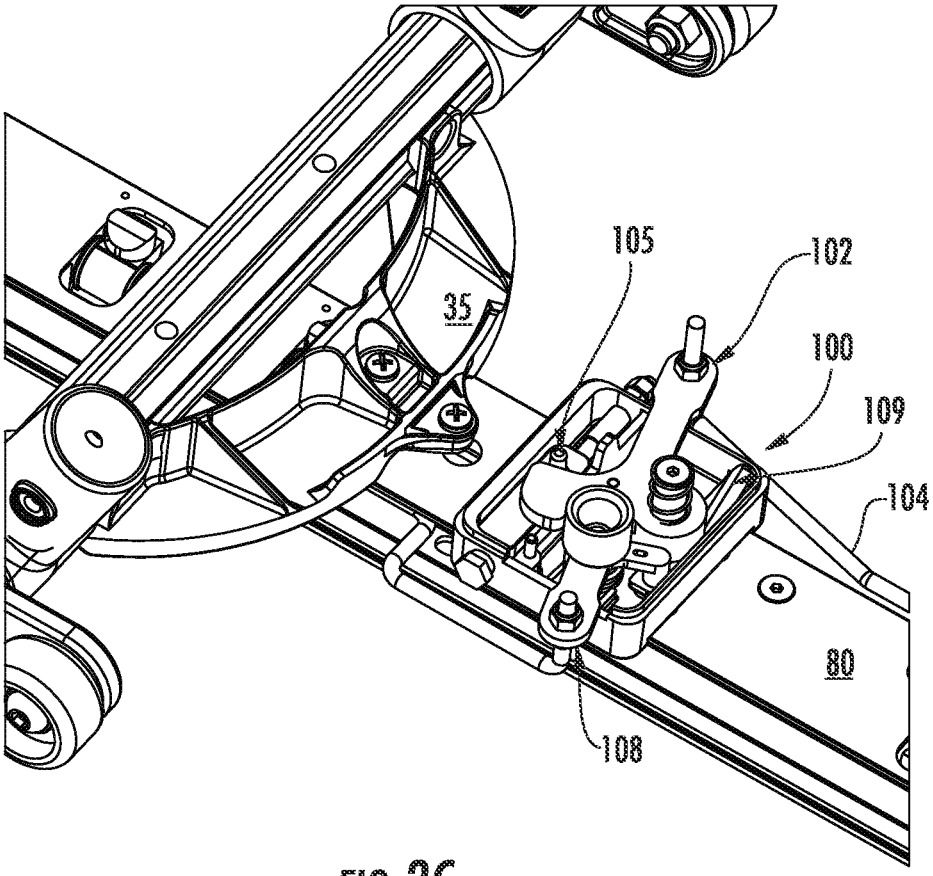
FIG. 3C is a perspective view of the middle control box at the loading position of FIG. 3A.
Figure 4A:
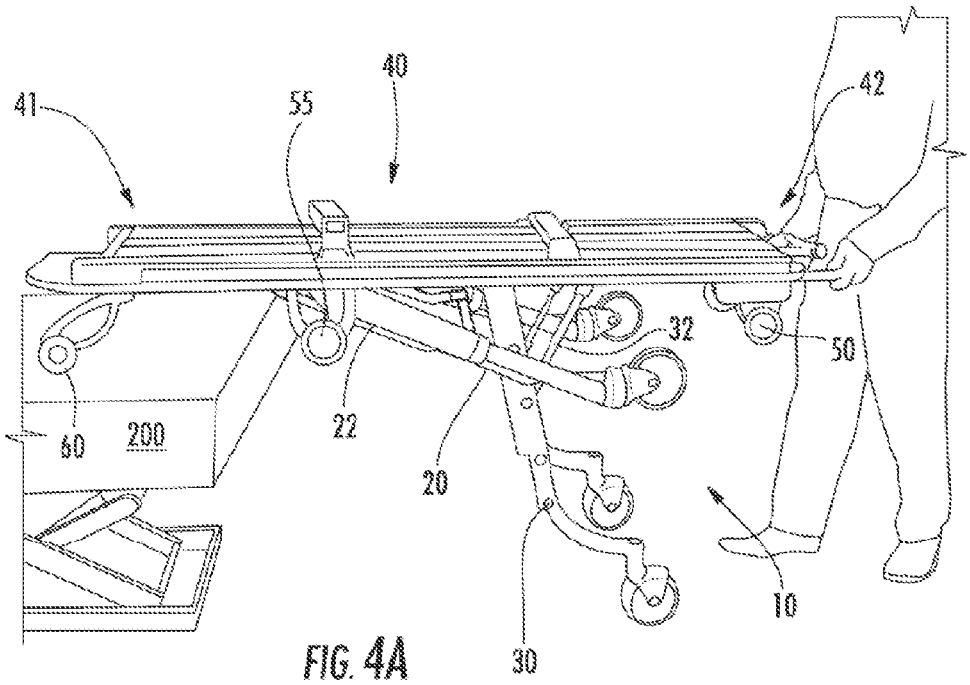
FIG. 4A is a side view of the roll-in cot collapsed to a point wherein the front actuator is activated, but before the weight is assumed by the operator according to one or more embodiments of the present disclosure.
Figure 4B:
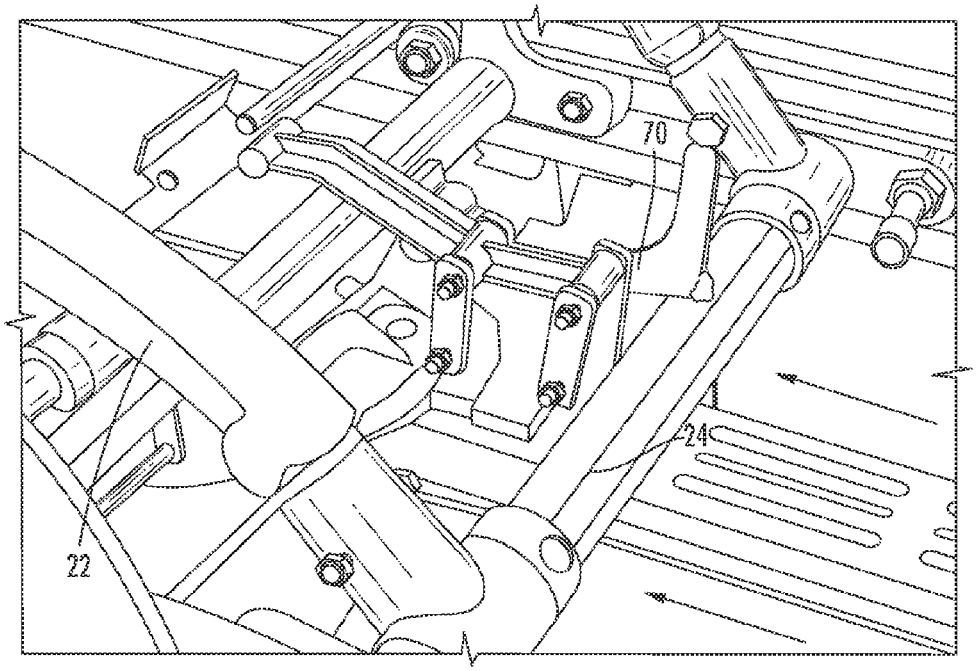
FIG. 4B is a close-up view of the front carriage member fully engaging the front actuator at the loading position of FIG. 4A.
Figure 11A:
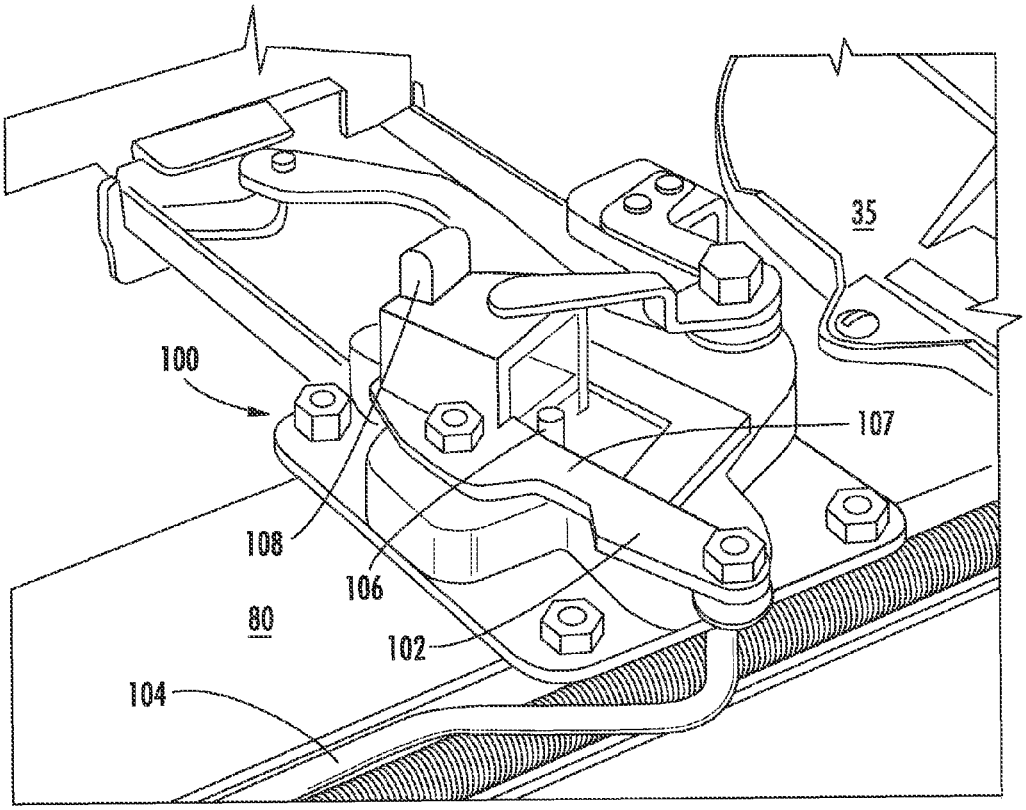
FIG. 11A is a perspective view of an alternative middle control box at the loading position of FIG. 1A.
Figure 11B:
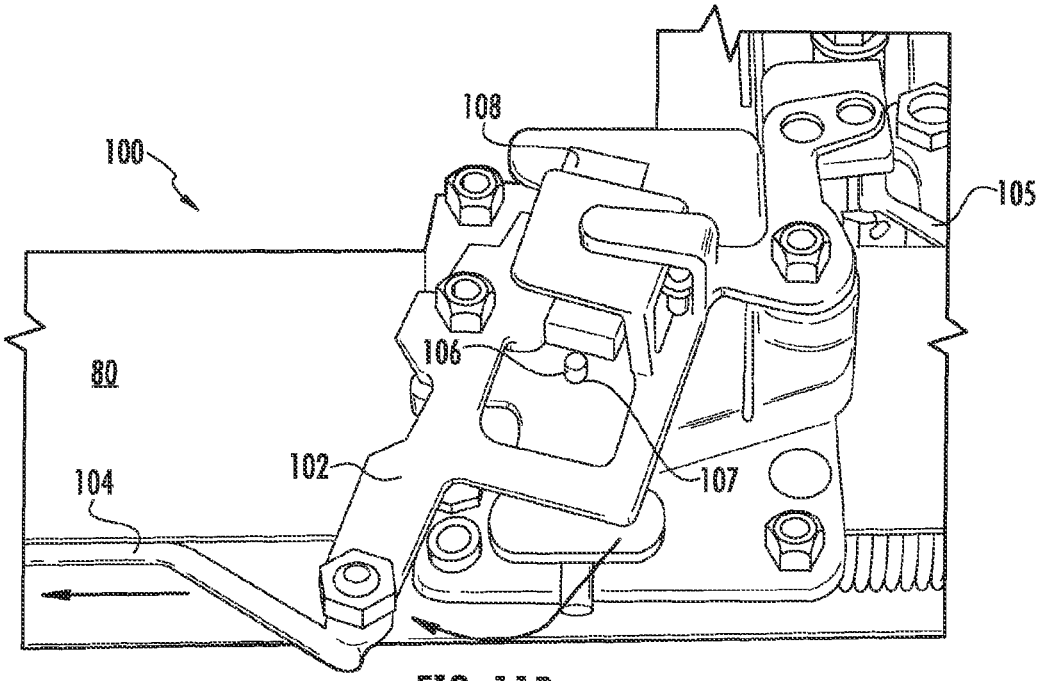
FIG. 11B is a perspective view of an alternative middle control box at the loading position of FIG. 3A wherein a swing latch attached to the middle release lever pushes the slider.

Referring to FIGS. 1C and 3C, the mechanical loading system 100 may also comprise a middle release lever 102 coupled to the front actuator 70. As shown, the middle release lever 102 may be disposed in a middle control box 110 disposed on the support beam 80. Referring to the embodiment of FIGS. 3C and 4C, the middle release lever 102 is coupled to the front actuator 70 by front linkage 104 and spring member 112. When the front actuator 70 is triggered, the spring 112 is placed under tension, and this spring tension prevents the movement of middle release lever until the latch pin 120 is disengaged from scallop 114 by the user bearing a portion of the weight as described below. Once the weight has been removed from the rear legs of the cot, the tension in the spring 112 is released and the middle release lever 102 is able to move, thereby triggering the slider 105 to move. The middle control box 110 further comprises a swing latch 108 triggered by the movement of the reset actuator 130 as described below. Alternative embodiments of the middle control box 110 are shown in FIGS. 11A and 11B.

Figure 6A:
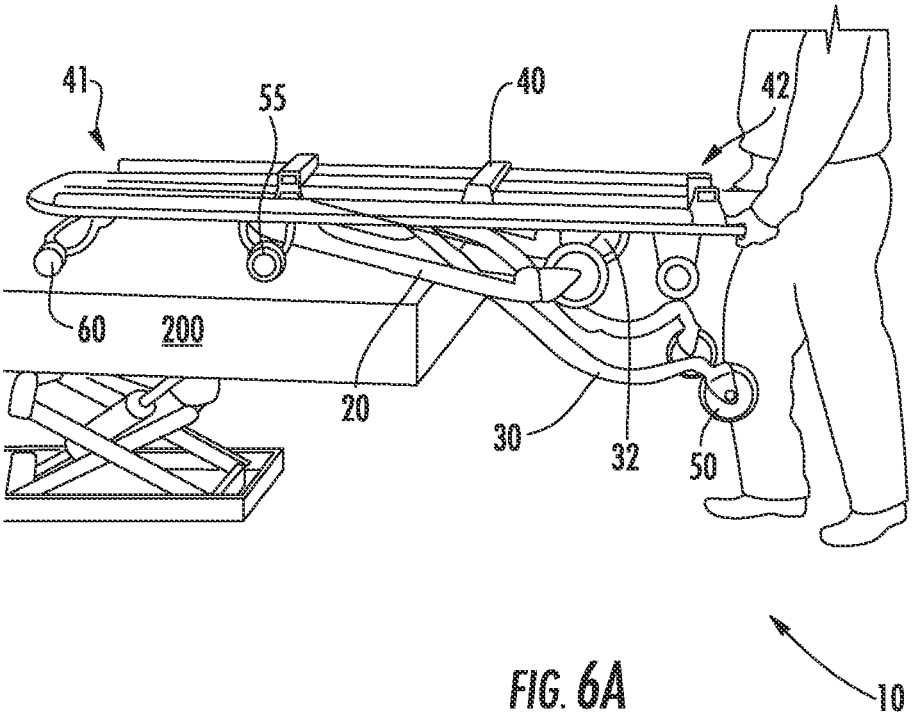
FIG. 6A is a side view of a roll-in cot as the operator assumes the weight and the rear carriage member moves to rotate the latch pin to automatically release the trailing legs.
Figure 6B:
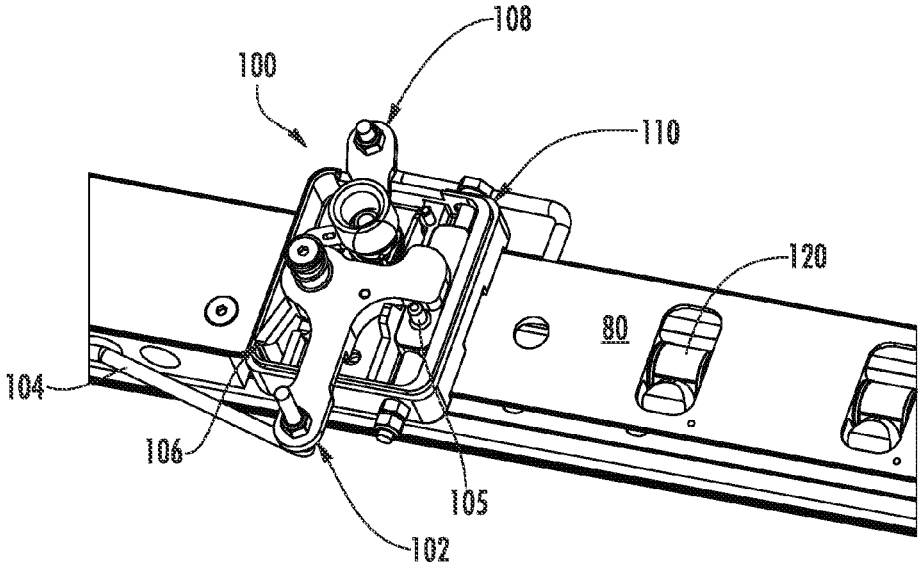
FIG. 6B is a close-up view of the mechanical loading system with open latch pins at the loading position of FIG. 6A.
Figure 6C:
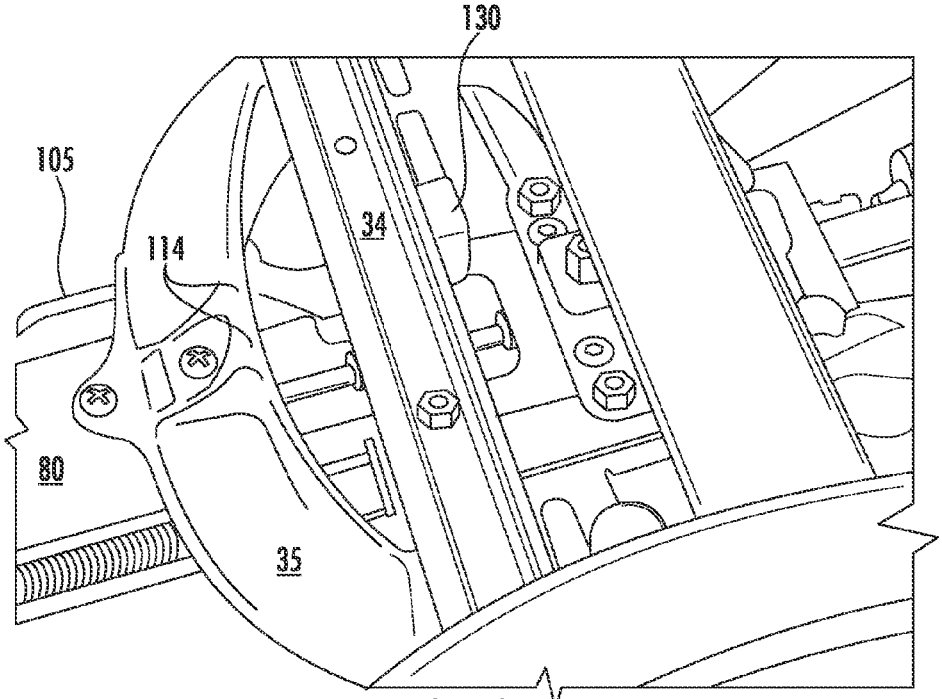
FIG. 6C is a close-up view of the rear carriage member moving closer to the reset actuator at the loading position of FIG. 6A.
Figure 8:
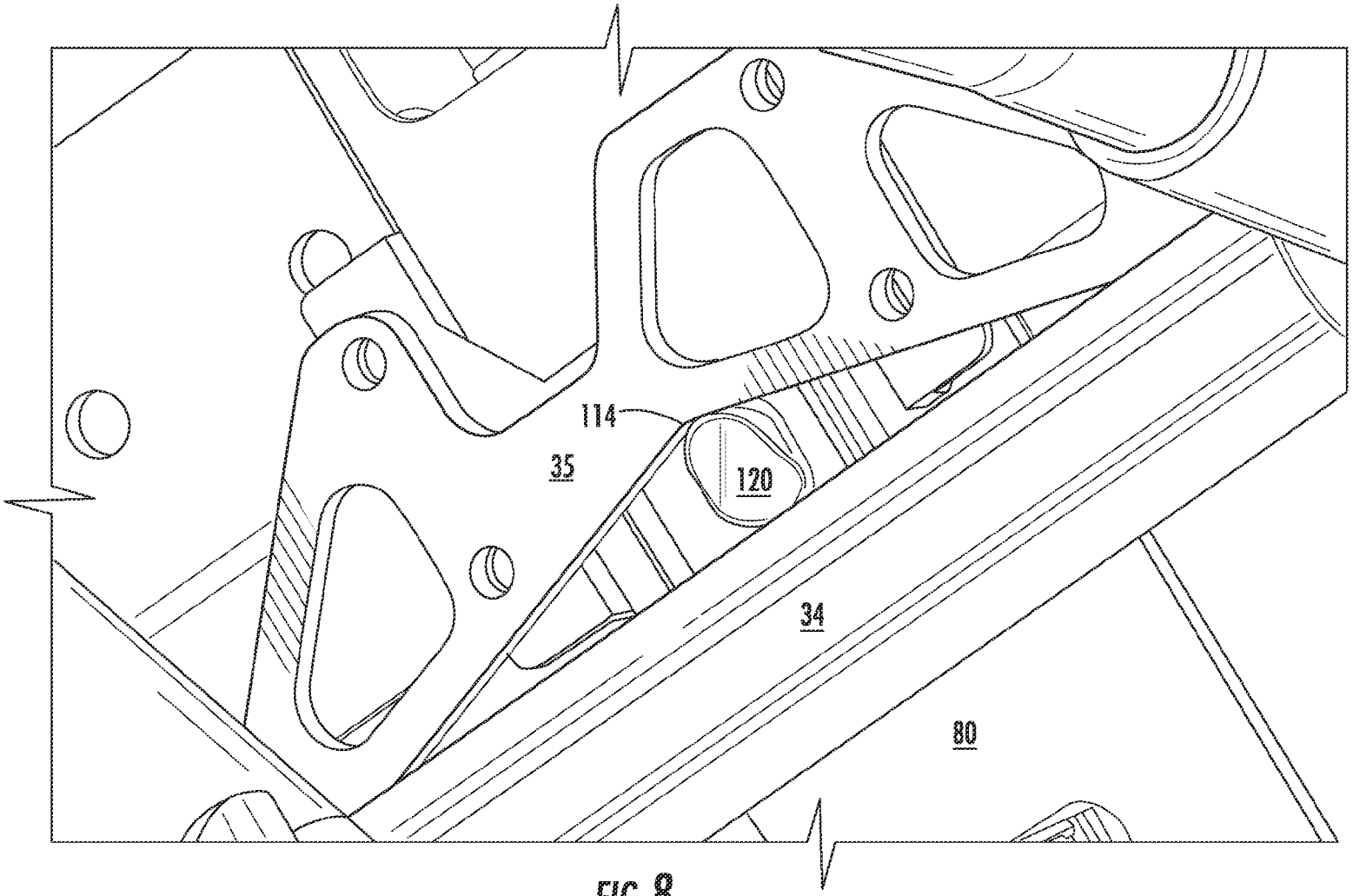
FIG. 8 is an underside view of a latch pin forming an interference fit on a curved projection of the rear carriage member.

Referring to FIGS. 6C and 8, the rear carriage member 34 may be slidingly coupled to the pair of slidable tracks 45 at the rear end 42 of the support frame 40, with the rear carriage member 34 optionally comprising a bracket with curved projections and the mechanical loading system comprising a latch pin 120, with the latch pin 120 optionally being configured to lock the trailing legs 30 by forming an interference fit with the curved projections of a rear carriage member bracket 34 as shown in FIG. 8. A boomerang bracket 35 configuration is shown for the rear carriage member bracket, but the bracket could be any type of bracket that could form an interference fit. The bracket may also include scallops or inward projections 114 configured to produce the interference fit.

Figure 7A:
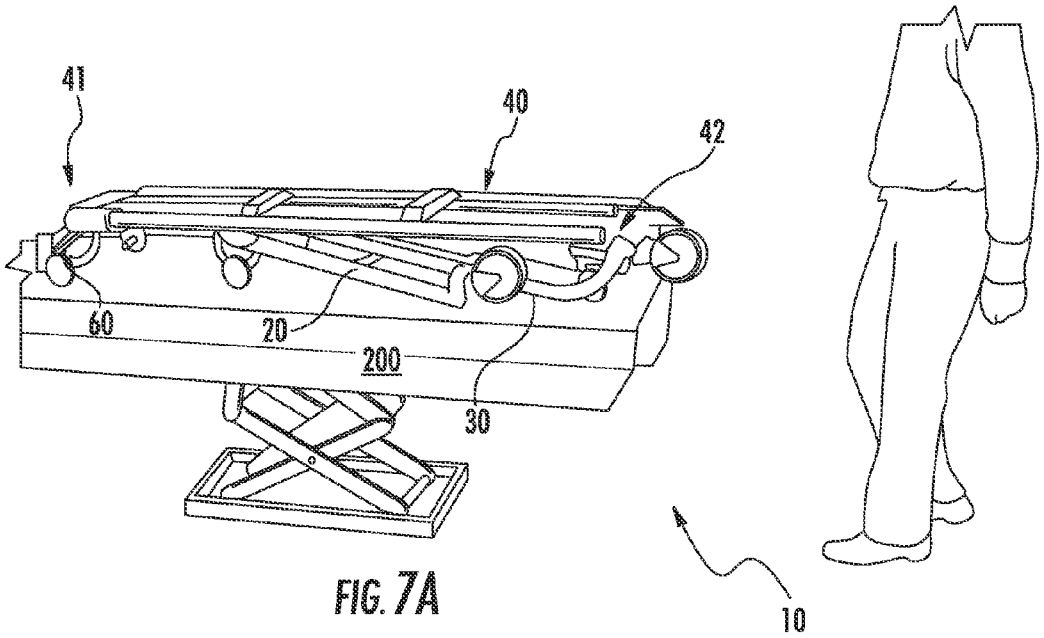
FIG. 7A is a side view of the roll-in cot fully loaded onto a platform.
Figure 7B:
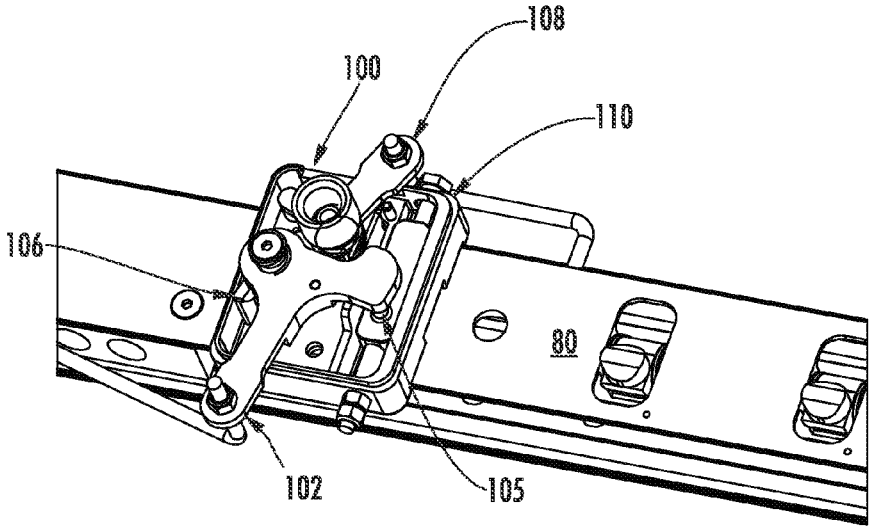
FIG. 7B is a close-up view of the middle control box and the open latch pin when the roll-in cot is fully loaded as in FIG. 7A.

Referring to FIGS. 6A and 6C, in yet another option, the interference fit between the latch pin 120 and the bracket may be optionally disengaged by an operator supporting a portion of the weight of the cot 10, which triggers the release of the trailing legs 30. Optionally, the rear carriage member 34 may define a motion path for a reset actuator 130 disposed on the support frame 40 such that movement of the rear carriage member 34 in conjunction with the folding of the trailing legs 30 triggers the reset actuator 130. The triggering of the reset actuator 130 locks the roll in cot 10 when the trailing 30 and leading 20 legs of the cot 10 are in a folded position, as shown in FIG. 6A. Referring to FIG. 7B, the rear carriage 34 engages the reset actuator 130, which pulls the swing latch 108. When the swing latch 108 is pulled, the sliding wedge 109 moves inside the middle control box 110 and is wedged underneath and raises the middle release lever 102. At which point, the middle release lever 102 will raise above the post on the top of slider 105. Once this occurs, the middle release lever 102 is no longer controlling the latch pins 120, and the pins 120 will return to their default, upright position, as can be seen in FIG. 7B Various components may be used for the reset actuator 130, such as a switch, lever, button, and so forth. Although the motion of the leading legs 20 and trailing legs 30 are depicted as pivoting inwardly, it is also contemplated that they could pivot outwardly, slide, or the like. In one embodiment, the trailing legs 30 may be coupled to the slidable tracks 45. The trailing legs 30 are depicted as being curved in FIG. 1A; however, various shapes and curvatures are contemplated for the trailing legs 30. Additionally, as shown, the trailing legs 30 include wheels at their lower end. The rear carriage member 34 may also be disposed between respective slidable rear hinge members 32. The rear carriage member 34 may be a crossbar, frame, latch, horizontal assembly, or any other moveable component.

Figure 9:
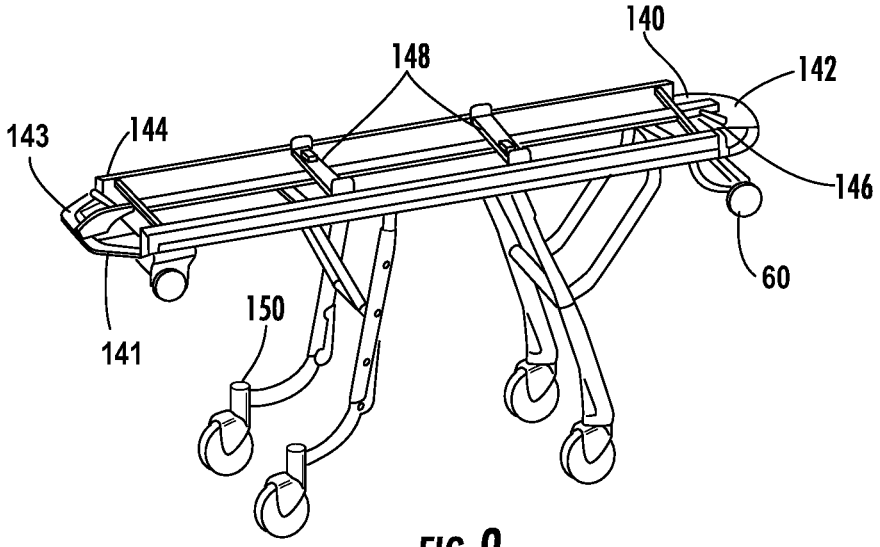
FIG. 9 is another embodiment of the roll-in cot.

Referring to FIG. 9, there may optionally be at least one load wheel 60 disposed at the front end 41 of the support frame 40, with a swivel lock release lever 146 optionally disposed at the front end 41 of the support frame 40, whereby the swivel lock release lever 146 unlocks the at least one front load wheel 60 to allow swivel motion for the at least one front load wheel 60. The wheel locks 150 are designed to help keep the cot from rolling during patient transfer and certain medical procedures. To disengage the lock 150, the operator may lift the lever with his/her foot.

Referring to FIGS. 1A and 9, optionally, at least one intermediate load wheel 55 may be disposed on the support frame 40 between the leading 20 and trailing legs 30. Yet another option is at least one load wheel 50 disposed at the rear end 42 of the support frame 40, where, optionally, a swivel lock release lever 146 unlocks the at least one rear load wheel 50 to allow swivel motion of the at least one rear load wheel 50. In yet another embodiment, the roll-in cot 10 is comprised of at least one load wheel 50 disposed at the rear end 42 and at least one front load wheel 60 disposed at the front end 41.

Referring to FIG. 9, in yet another option, the cot 10 may have a front leg control handle 140 disposed at the front end 41 of the support frame 40, whereby the front leg control handle 140 disengages a locking mechanism that allows the folding of the leading legs 20. Another option is a rear leg control handle 141 disposed at the rear end 42 of the support frame 40, whereby the rear leg control handle 141 disengages a locking mechanism that allows the folding of the trailing legs 30. The front leg handle 140 and the rear leg handle 141 may be a button, lever, switch or other mechanical component that disengages the locking mechanism. The locking mechanism may comprise any suitable electronic or mechanical fastening mechanism that holds the legs in an upright position.

Referring again to FIG. 9, the cot 10 may also optionally comprise a front leg lock switch 142 disposed at the front end 41 of the support frame 40, whereby the front leg lock switch 142 engages a locking mechanism to lock the leading legs 20 in a folded position. Another option is a rear leg lock switch 143 disposed at the rear end 42 of the support frame 40, whereby the rear leg lock switch 143 engages a locking mechanism to lock the trailing legs 30 in a folded position. The front leg lock switch 142 and the rear leg lock switch 143 may be a button, lever, handle or other mechanical component that locks the legs.

Figure 10:
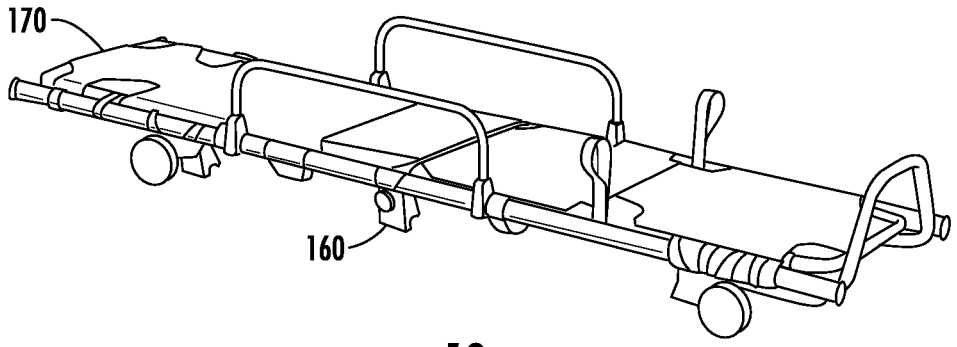
FIG. 10 is a perspective view of a stretcher, which may be attached to the roll-in cot of FIG. 9.

Referring to FIGS. 9 and 10, the cot 10 may also optionally comprise a release handle 144 disposed at the rear end 42 of the support frame 40, whereby the release handle 144 allows for a stretcher to be removed from the cot 10. The cot 10 may also optionally comprise a pair of slam latches 148 mechanically fitted to a linkage component coupled to the pair of lateral sides, wherein the latches 148 secure a stretcher (as shown in FIG. 10) or other mobility device to the cot 10. The stretcher slam latches 148 capture and secure the stretcher 170 on the cot 10. To engage the latches 148, the stretcher 170 is rolled onto the cot until the locks of the slam latches 148 engage. To disengage, the operator pushes the stretcher-lock release handle 144 at the control end of the cot 10. Both operators then roll the stretcher slightly toward the loading end of the cot to move the stretcher strike pins 160 out of the locks. The operator then releases the lever and grasps the stretcher 170 with both hands before both operators lift the stretcher 170 off the transporter.

Referring generally to FIGS. 2A-7A, a method of operation of a roll-in cot 10 for transport onto a first surface is shown according to one embodiment. Referring to FIGS. 1B and 1D, when the cot 10 is fully extended and positioned in a preloading configuration, the front actuator 70 (FIG. 1B) and the reset actuator 130 (FIG. 1D) are deactivated until loading according to one embodiment. Referring to FIG. 2A, the method comprises loading of the roll-in cot 10 onto a first surface thereby releasing automatically at least one leading leg 20. Referring to FIGS. 3A-3C, the method further comprises continuing of loading the roll-in cot 10 onto a first surface to move a front carriage member 24 toward a front actuator 70 (FIG. 3B), such that movement of the front carriage member 24 triggers the front actuator 70 the pull the middle release lever 102 (FIG. 4B).

Figure 4C:
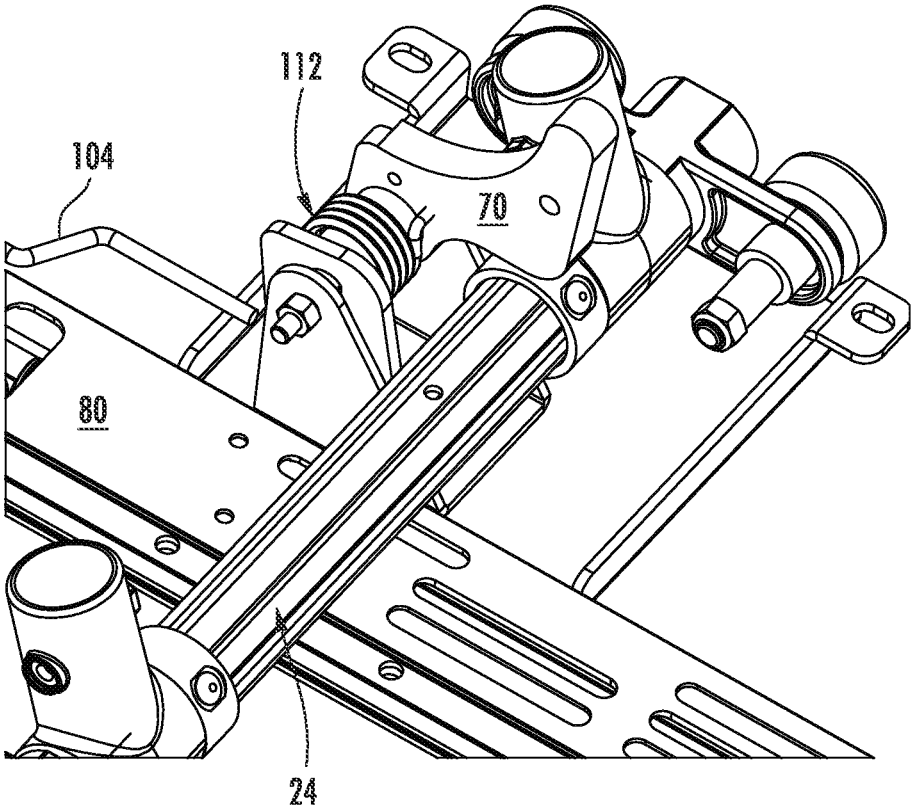
FIG. 4C is a close-up view of the spring biased mechanical linkage which couples the middle release lever to the front actuator at the loading position of FIG. 4A.

Referring to FIG. 4C, the latch pin 120 is unable to rotate, which prevents motion of the middle release lever 102 and energy is stored in the spring 112 biased mechanism attached to the front actuator 70. The latch pin 120 remains resting within the curved projections 114.

Figure 5:
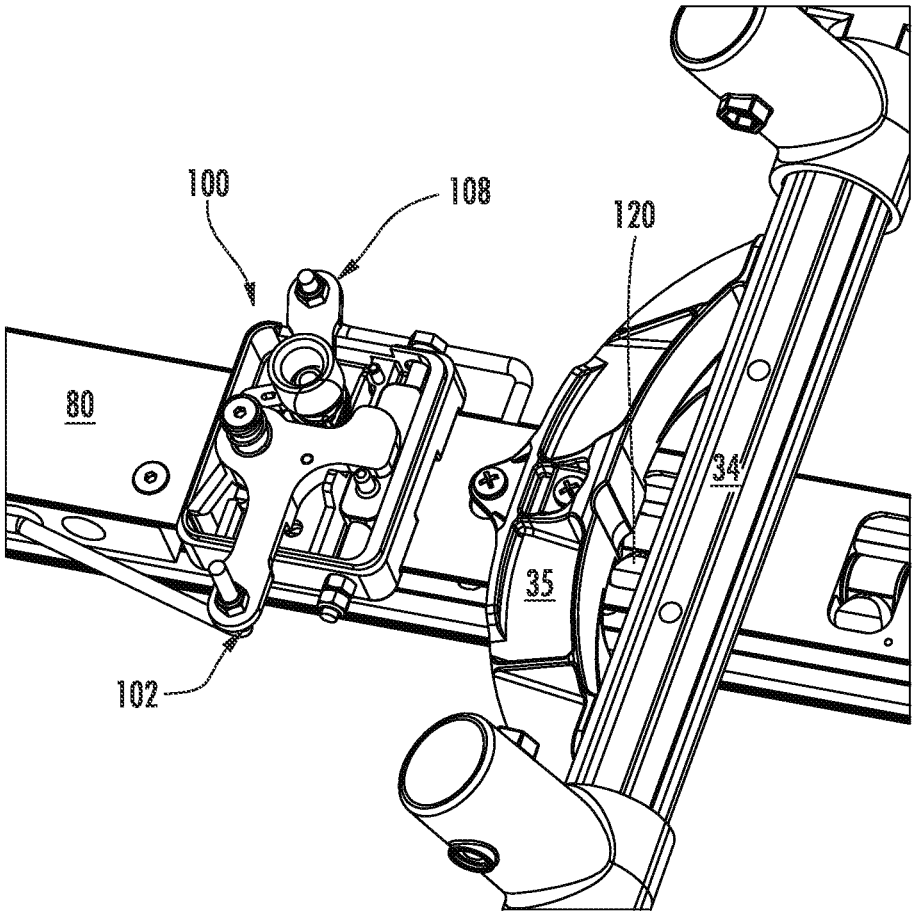
FIG. 5 is a perspective view of the latch pin rotated out of the way.

Referring to FIG. 6A, the lifting of the rear end 42 of the roll-in cot 10 is performed by an operator that assumes the weight of the cot 10. The operator will have to lift slightly to "see saw" the front end 41 of the support frame 40 down using the intermediate load wheels 55 as a pivot. Referring to FIG. 5, when the operator lifts the rear of the cot 10 slightly off of the ground, the rear carriage 34 slides slightly forward, thereby allowing the spring biased mechanism 112 of the mechanical loading system 100 to overcome the interference fit between the latch pin 120 and curved projections 114. The latch pin 120 may then rotate to the open position as shown in FIG. 6B. This movement of the latch pin 120 enables the trailing legs 30 to be released.

It is contemplated that this lifting effort by the operator could be eliminated by using a fastener that holds the front axle down in some manner, either through a traveling front lock, or by using a rolling or sliding element on the load axle moving through a stationary channel mounted to the fastener surface.

Figure 7C:
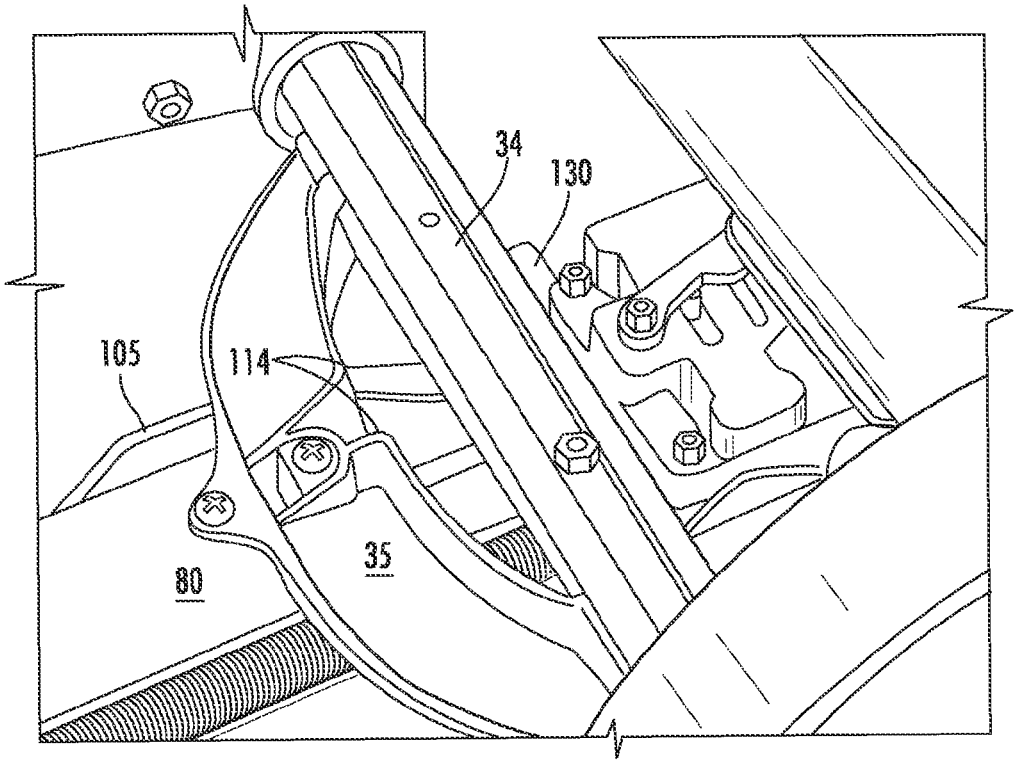
FIG. 7C is a close-up view of the reset actuator at the loading position of FIG. 7A.

Referring to FIG. 6A, the trailing legs 30 may then collapse backwards onto the loading surface 200. As the trailing legs 30 collapse, the rear carriage member 34 moves closer to the reset actuator 130 as shown in FIG. 6C. FIG. 7A depicts the cot 10 fully folded and loaded on the first surface 200. Referring to FIG. 7C, as the trailing legs 30 swing backward when fully loaded, the rear carriage member 34 slides and engages the reset actuator 130. Referring to FIG. 7B, the latch pin is reset.

Referring to FIG. 7B, the engagement of the reset actuator 130 pulls the middle release lever 102. The movement of the middle release lever 102 causes the swing latch 108 to open thereby allowing the slider 105 to be disengaged. Additionally, once the middle release lever 102 is no longer controlling the position of the latch pins 120, the pins are reset as shown in FIG. 7B.

Figure 11C:
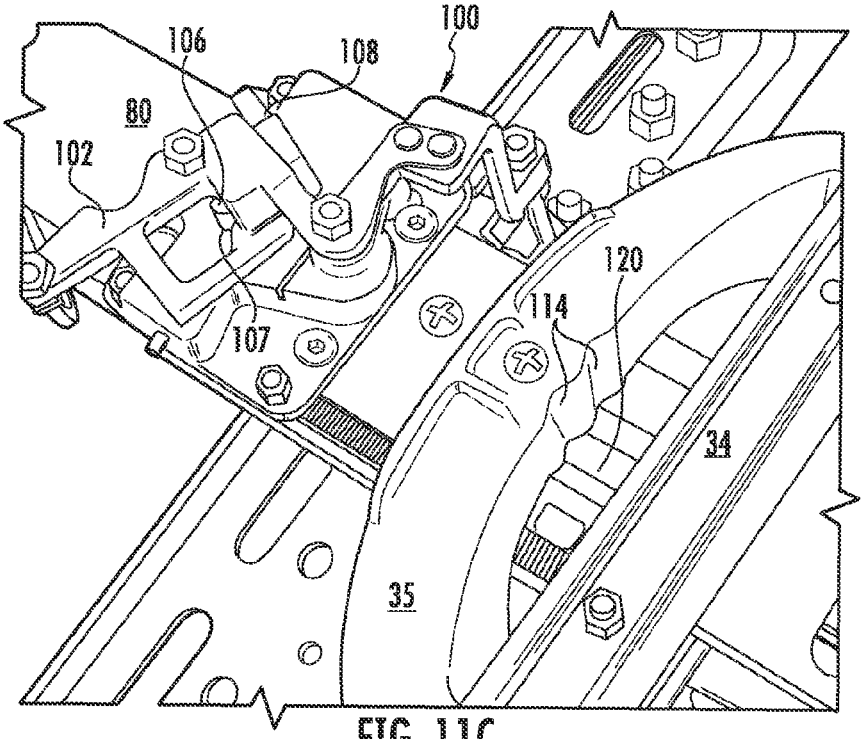
FIG. 11C is a perspective view of an alternative middle control box at the loading position of FIG. 4A with its release lever fully pulled, where the latch pin has not been released.
Figure 11D:
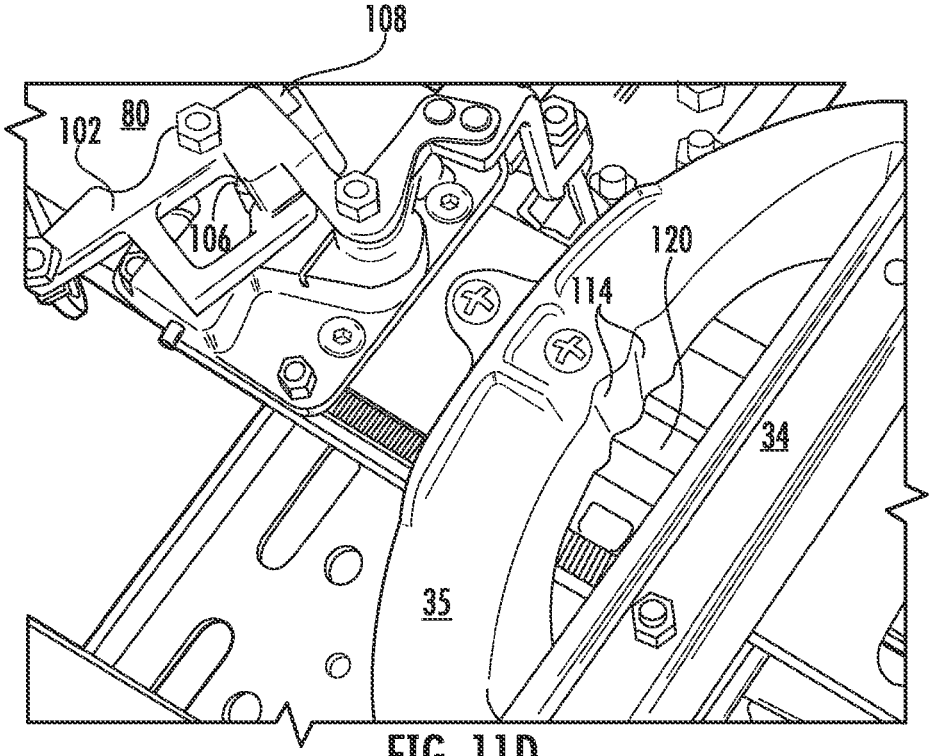
FIG. 11D is a perspective view of an alternative middle control box at the loading position of FIG. 5 with its latch pin rotated out of the way.
Figure 11E:
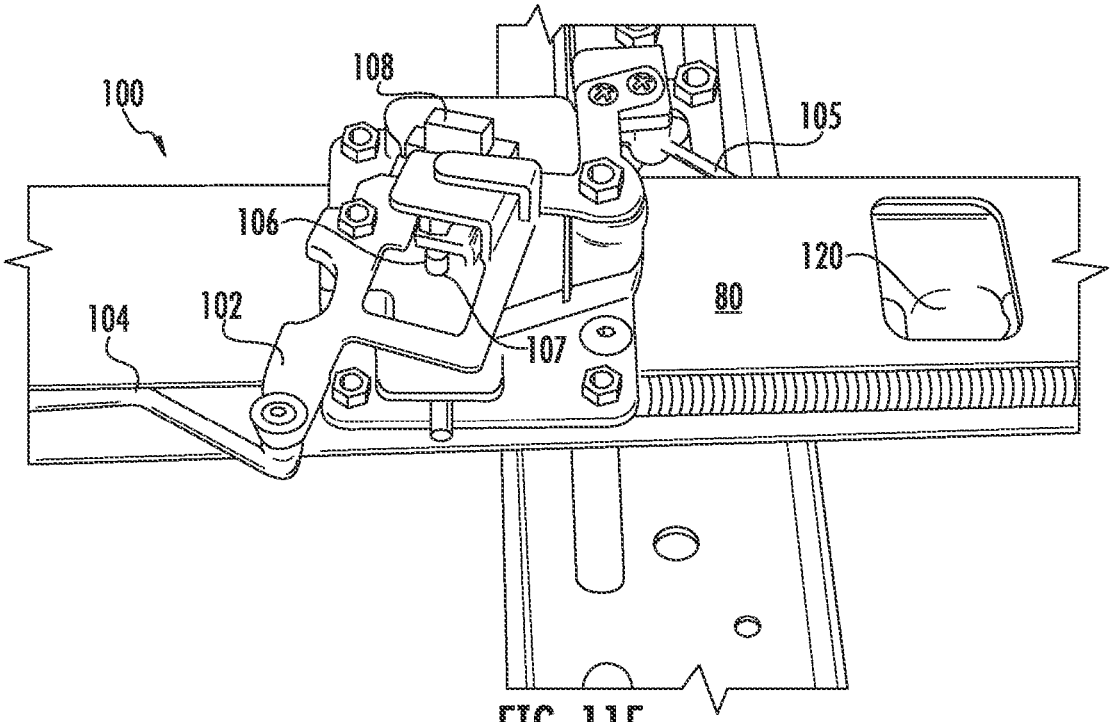
FIG. 11E is a perspective view of an alternative middle control box at the loading position of FIG. 6A wherein the latch pins are open.
Figure 11F:
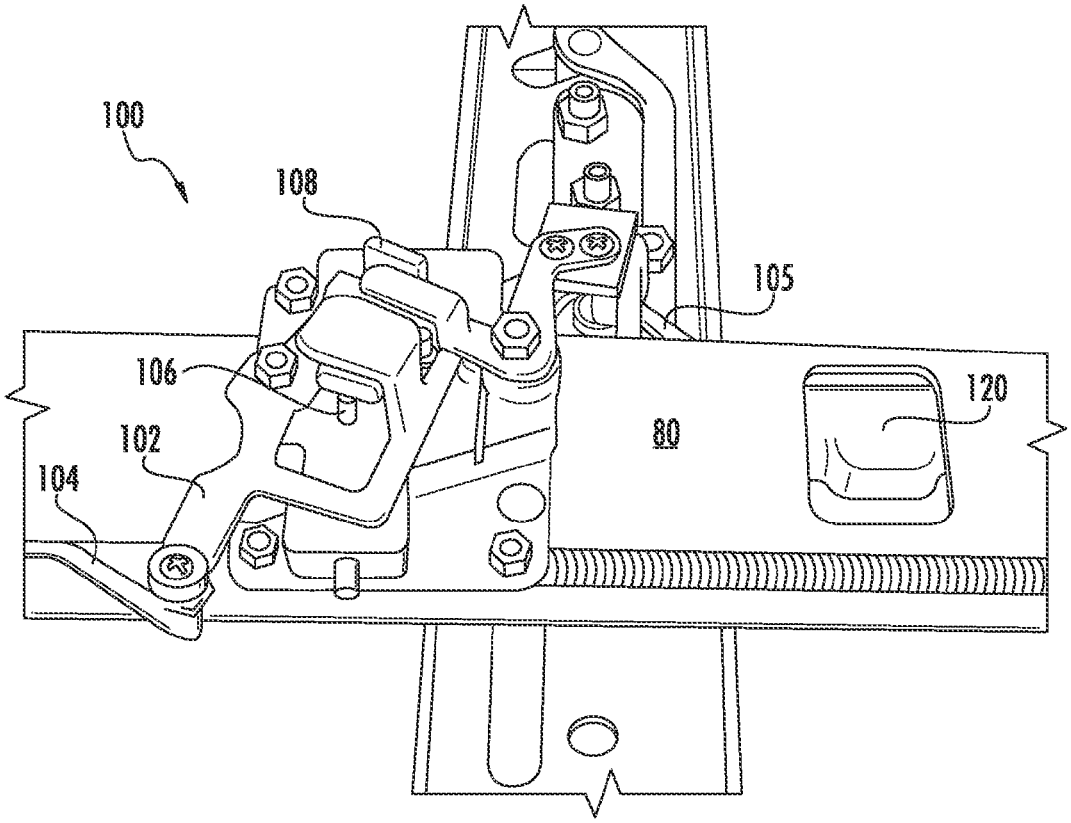
FIG. 11F is a perspective view of an alternative middle control box at the loading position of FIG. 7A wherein the roll-in cot is fully loaded onto a surface.

As stated above, another embodiment of the mechanical loading system 100 is shown in FIGS. 11A-11F. This embodiment comprises a middle release lever 102, a swing latch 108, and a sliding pin 106. The sliding pin 106 moves within track 107 during loading and unloading of the cot. It further comprises a spring biased mechanism (not shown), which is connected to the latch pin 120. Referring to FIG. 11A, the mechanical loading system 100 is deactivated. Referring to FIG. 11B, the middle release lever 102 is pulled by way of the front linkage 104. The swing latch 108, which is attached to the middle release lever 102, pushes the sliding pin 106 within track 107 in response to the movement of the middle release lever 102. As shown in FIG. 11C, the middle release lever 102 is fully pulled, but the latch pin 120, which is coupled to the middle release lever 102 through a spring biased mechanism, has not released, because the pin 120 has formed a locking interference fit with the scallops or curved projections 114 of boomerang bracket 35. Referring to FIG. 11D, when the operator lifts the rear of the cot 10 slightly off of the ground, the rear carriage 34 slides slightly forward, thereby allowing the spring biased mechanism inside of the mechanical loading system 100 to overcome the interference fit between the latch pin 120 and curved projections 114 of bracket 35. The latch pin 120 may then rotate to the open position as shown in FIG. 11E. Finally, the movement of the middle release lever 102 triggers the spring biased mechanism to reset the ratcheting latch pins 120 as shown in FIG. 11F.

The cot may also be unloaded in a reverse manner. When the operator begins to remove the cot 10 from the folded position on the first surface 200, the trailing legs 30 swing forward. In conjunction with the movement of the trailing legs 30, the rear carriage member 34 moves away from the reset actuator 130. This disengages the middle reset lever 102. At the same time, the swing latch 108 continues to be disengaged, which thereby allows the latch pins 120 to rotate out of the way as the rear carriage member 34 slides forward. That being said, the latch pins 120 may still serve as a hard stop if the rear carriage member 34 slides backwards. At this stage of unloading as shown in FIG. 8A, the weight of the cot 10 can safely be borne by the trailing legs 30. As the operator continues to unload the cot 10 from a first surface 200, the leading legs 20 swing forward, disengaging the front actuator 70 and returning the swing latch 108 to its initial position as shown in FIG. 1C. At which point, the cot 10 is fully extended and ready to be loaded onto a first surface 200 again.

It is further noted that terms like "preferably," "generally", "commonly," and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

Having described the present disclosure in detail and by reference to specific embodiments thereof, it will be apparent that modifications and variations are possible without departing from the scope of the invention defined in the appended claims. More specifically, although some aspects of the present invention are identified herein as preferred or particularly advantageous, it is contemplated that the present invention is not necessarily limited to these preferred aspects of the disclosure.

All documents cited in the Detailed Description section, in relevant part, incorporated herein by reference; the citation of any document is not to be construed as an admission that it is prior art with respect to the present invention. To the extent that any meaning or definition of a term in this written document conflicts with any meaning or definition of the term in a document incorporated by reference, the meaning or definition assigned to the term in this written document shall govern.

The invention claimed is:

1. A method of operation of a roll-in push cot for transport onto a first surface, the method comprising:

initially loading the roll-in cot onto a first surface thereby releasing automatically at least one leading leg;

continuing of loading the roll-in cot onto the first surface to move a front carriage member toward a front actuator, such that movement of the front carriage member triggers the front actuator that releases a middle release lever, thereby initiating the release of at least one trailing leg, wherein the middle release lever is coupled to the front actuator by a linkage and a spring such that when the front actuator is triggered, the spring is placed under tension thereby preventing movement of the middle release lever until a locking mechanism is disengaged;

supporting the weight of the cot at least partially in order to disengage the locking mechanism for the at least one trailing leg such that the tension in the spring is released and the middle release lever is able to move; and loading the cot in order to move a rear carriage member in conjunction with folding of the at least one trailing leg and thereby trigger a reset actuator and release a latch pin to engage the rear carriage member when the trailing and leading legs of the roll-in push cot are in a fully folded position on the first surface;

wherein the roll-in push cot comprises a support frame comprising a pair of lateral sides extending between a front end and a rear end and supporting the weight at least partially is performed by an operator that assumes the weight of the cot by lifting of the rear end of the roll-in cot.

2. The method of claim 1, wherein the front actuator and reset actuator are deactivated while initially loading the roll-in push cot onto the first surface.

3. The method of claim 1, wherein releasing of the middle release lever does not release the at least one latch pin.

4. The method of claim 1, wherein the triggering of the reset actuator pulls a middle reset switch that resets the at least one latch pin.

5. The method of claim 1, wherein the roll-in push cart comprises a pair of slidable tracks disposed in the lateral sides.

6. The method of claim 5, wherein the front carriage member is slidingly disposed within the pair of slidable tracks at the front end of the support frame, wherein the sliding motion of the front carriage member defines a motion path.

7. The method of claim 5, wherein the rear carriage member is slidingly coupled to the pair of slidable tracks at the rear end of the support frame and the reset actuator is disposed on the support frame in a motion path defined by the rear carriage member such that movement of the rear carriage member in conjunction with the folding of the at least one trailing leg triggers the reset actuator, the triggering of the reset actuator being configured to lock the roll in cot when the trailing and leading legs of the cot are in a folded position.

8. The method of claim 1, wherein the rear carriage member comprises a bracket with curved projections, and wherein the roll-in push cot comprises a latch pin, the latch pin being configured to lock the trailing legs by forming an interference fit with the curved projections of the rear carriage member bracket.

9. The method of claim 8, wherein the interference fit between the latch pin and the bracket is disengaged by an operator supporting a portion of the weight of the roll in cot, the disengagement of the latch pin triggering the release of the trailing legs.

10. The method of claim 1, the roll-in push cot further comprising at least one load wheel disposed at the front end of the support frame.

11. The method of claim 10, the roll-in push cot further comprising a swivel lock release lever disposed at the front end of the support frame, whereby the swivel lock release lever unlocks the at least one front load wheel to allow swivel motion.

12. The method of claim 1, the roll-in push cot further comprising at least one intermediate load wheel disposed on the support frame between the leading and trailing legs.

13. The method of claim 1, the roll-in push cot further comprising at least one load wheel disposed at the rear end of the support frame.

14. The method of claim 13, the roll-in push cot further comprising a swivel lock release lever disposed at the rear end of the support frame, whereby the swivel lock release lever unlocks the at least one rear load wheel to allow swivel motion.

15. The method of claim 1, the roll-in push cot further comprising a release handle disposed at the rear end of the support frame, whereby the release handle allows for a stretcher to be removed from the cot.

16. The method of claim 1, the roll-in push cot further comprising a pair of slam latches mechanically fitted to a linkage component coupled to the pair of lateral sides, wherein the latches secure a stretcher to the cot.

17. A method of operation of a roll-in push cot for transport onto a first surface, the method comprising:

initially loading the roll-in push cot onto a first surface thereby releasing automatically at least one leading leg, wherein the roll-in push cot comprises a support frame comprising a pair of lateral sides extending between a front end and a rear end;

continuing of loading the roll-in cot onto the first surface to move a front carriage member toward a front actuator, such that movement of the front carriage member triggers the front actuator that releases a middle release lever, thereby initiating the release of at least one trailing leg, wherein the middle release lever is coupled to the front actuator by a linkage and a spring such that when the front actuator is triggered, the spring is placed under tension thereby preventing movement of the middle release lever until a locking mechanism is disengaged;

supporting the weight of the cot at least partially in order to disengage the locking mechanism for the at least one trailing leg such that the tension in the spring is released and the middle release lever is able to move, wherein supporting the weight at least partially is performed by an operator that assumes the weight of the cot by lifting of the rear end of the roll-in cot; and loading the cot in order to move a rear carriage member in conjunction with folding of the at least one trailing leg and thereby trigger a reset actuator and release a latch pin to engage the rear carriage member when the trailing and leading legs of the roll-in push cot are in a fully folded position on the first surface, wherein the rear carriage member is slidingly coupled to the pair of slidable tracks at the rear end of the support frame and the reset actuator is disposed on the support frame in a motion path defined by the rear carriage member such that movement of the rear carriage member in conjunction with the folding of the at least one trailing leg triggers the reset actuator.

18. The method of claim 17, wherein the rear carriage member comprises a bracket with curved projections, and wherein the roll-in push cot comprises a latch pin, the latch pin being configured to lock the trailing legs by forming an interference fit with the curved projections of the rear carriage member bracket.

19. The method of claim 18, wherein the interference fit between the latch pin and the bracket is disengaged by an operator supporting a portion of the weight of the roll in cot, the disengagement of the latch pin triggering the release of the trailing legs.

* * * * *